United States Patent [19]

Jacques

[11] 4,223,785

[45] Sep. 23, 1980

[54] HAND HELD STRINGED INSTRUMENT CASE AND STAND

[76] Inventor: Jacques, 2233 Park Ave., Cincinnati, Ohio 45206

[21] Appl. No.: 44,204

[22] Filed: May 31, 1979

[51] Int. Cl.[3] ..... A45C 11/00

[52] U.S. Cl. ..... 206/314; 220/4 B

[58] Field of Search ..... 206/314, 14, 545; 220/4 B

[56] References Cited

U.S. PATENT DOCUMENTS

| | | | |
|---|---|---|---|
| 1,352,814 | 9/1920 | Kirk | 206/314 |
| 3,138,254 | 6/1965 | Knapp | 206/545 |
| 3,310,905 | 3/1967 | Davis et al. | 220/4 B |
| 3,845,875 | 11/1974 | Douglas et al. | 206/545 |
| 4,147,254 | 4/1979 | Bruce | 206/314 |
| 4,151,909 | 5/1979 | Markov | 206/314 |

*Primary Examiner*—William T. Dixson, Jr.
*Attorney, Agent, or Firm*—Frost & Jacobs

[57] ABSTRACT

A combination case and stand for a hand held stringed instrument. The case has a body portion and a neck portion and the lower end thereof is provided with a flat bottom supporting surface lying at an angle of about 80° with the long axis of the case. A pair of doors open and close upon themselves to define an instrument display position and an instrument carrying position, respectively. The doors in the open position defined an instrument receiving pocket and the stringed instrument may be positioned in the instrument receiving pocket by orientation 90° to its normal carrying position within the case.

8 Claims, 5 Drawing Figures

HAND HELD STRINGED INSTRUMENT CASE AND STAND

TECHNICAL FIELD

The present invention relates to a combination case and stand for a hand held stringed instrument.

BACKGROUND OF THE ART

Hand held stringed instrument, such as the guitar, banjo and mandolin, are commonly put in a case in order to transport the instrument while providing protection from rain, moderate weather changes and damage. Whenever the stringed instrument moves from transit to utilization the events are often difficult. A place must be found to either lay the instrument down or to lean it up against. Then a place must be found for the case while the instrument is played. When the stringed instrument is returned to its case, a leaning point or laying place must be found. In this regard, the prior art has generally utilized an instrument stand, such as a guitar stand. These are generally bent metal structures with foam coverings and for the most part are not even adequate, as the instrument is often easily knocked over.

Existing hand held stringed instrument cases include, at the low end of the line, a guitar bag. This is a vinyl bag with a cotton flannel backing. The instrument or guitar slips into the case neck first and closes by a zipper. It will easily be seen that the instrument bag provides minimum protection for the instrument contained therein. Exemplary of patents showing a soft bag-type case for hand held stringed instruments is U.S. Pat. No. 671,567, in the name of A. Shaeffer, showing a mandolin case having a wire frame and covered with cloth.

Another type of prior art case is the laminated chip board case with a vinyl covering. This offers a lot more protection and wear that does the instrument bag. Exemplary of an early type of instrument case similar to the laminated chip board case with a vinyl covering is shown in U.S. Pat. No. 306,731, in the name of A. C. Fairbanks, which discloses a case for banjos and other instruments having a flexible leather exterior.

Superior prior art cases are either the hard shell cases, made from wood veneer with a top quality vinyl coating and a heavily padded and plush velour interior lining, and plastic molded cases, which are also plush lined, and, like the hard shell cases, offer high protection and long life.

Even though the prior art hand held, stringed instrument cases have proven successful in a number of ways, they have many shortcomings. For example, they do not provide easy access to the instrument contained therein without laying the case down or leaning it against something, and they do not provide a stand for easy removal and replacement of the instrument.

U.S. Pat. No. 3,637,070, in the name of Perry L. Friedman, is an example of prior art patents disclosing a combination carrying case and stand for a belled musical instrument, such as a trumpet. This case not only protects the instrument while it is carried, but also provides a stand for the instrument when in use. However, a suitable combination case and stand has not been developed for hand held stringed instruments which is simple in design, adaptable to all types of case manufacturing materials, such as soft shell, hard shell and plastic molded, and fits many types of sizes and shaped hand held stringed instruments in one size and shape case.

DISCLOSURE OF THE INVENTION

The present invention provides a combination case and stand for a hand held stringed instrument. The case has a body portion and a neck portion and the lower end thereof is provided with a flat bottom supporting surface lying at an angle of about 80° with the long axis of the case. The two sides, top and rear surfaces of the case, along with the flat bottom supporting surface, all have front edges defining a substantially rectangular opening. The case is provided with a pair of doors which open and close upon themselves to define an instrument display position and an instrument carrying position, respectively. The pair of doors are hingedly affixed along the front edges of the side surfaces, the doors in the closed position defining continuations of the side surfaces and a front surface.

When the pair of doors is in the open position an instrument receiving pocket is defined. Accordingly, when the doors are in the open position, the instrument may be positioned in the instrument receiving pocket by orientation 90° to its normal carrying position within the case.

In practice it has been found that best results are obtained when the pair of doors in the open position form a 90° angle with the bottom supporting surface so as to provide side-to-side stability when the doors are in the open position. Further stability is provided by two stabilizer feet on the lower portion of the front surface of the doors.

When the pair of doors are in the closed position, the front and rear of an instrument carried in the case and stand face one of the side surfaces. A storage compartment may be secured to the neck portion of the side surface facing the rear of the instrument. This compartment is sufficiently large to accommodate picks and strings.

The case and stand of the present invention is easily carried because a handle is attached to the front surface formed by the doors.

It has been found that best results are obtained when the case and stand are manufactured from closed cell polyurethane foam covered with a suitable outer protective covering. This is so because closed cell polyurethane foam has the ability to condense a great deal and then return to its original shape. Therefore, depending on the thickness of the foam, the case will easily serve a number of hand held stringed instrument sizes.

The case and stand of the present invention provides a stand for the guitar which offers substantial stability. This is accomplished because of the flat bottom supporting surface, which lies at an angle of about 80° with the long axis of the case, and by the fact that the pair of doors in the open position form a 90° angle with the bottom supporting surface.

The present invention provides a combination case and stand for a hand held stringed instrument which provides protection, transportion and display of the instrument. It enables easy access to the instrument without laying the case down or leaning it against something, and provides a stable, safe stand for easy removal and replacement of the instrument. The case and stand of the present invention is adaptable to all types of case manufacturing materials, including soft shell, hard shell and plastic molded, and is capable of fitting many types of sizes and shaped hand held stringed instruments, in one size and shape combination case and stand. The case and stand is adaptable for use with a variety of hand held stringed instruments, including guitars, such as acoustical guitars and electric guitars, banjos, mandolins, violins, etc.

DETAILED DESCRIPTION OF THE INVENTION

Figure 2:
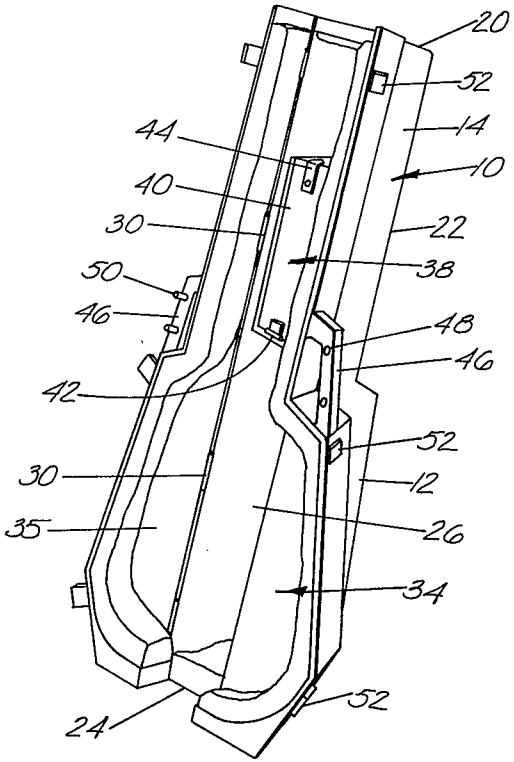
FIG. 2 is a perspective view similar to FIG. 1 showing the doors in the open position with an instrument receiving pocket.
Figure 1:
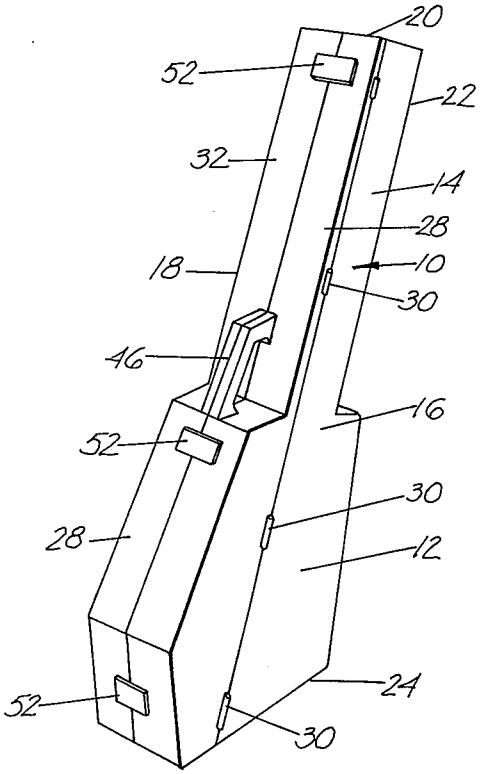
FIG. 1 is a perspective view of the combination case and stand of the present invention showing the doors closed and the case and stand in the carrying position.

Referring to the drawings, and in particular to FIGS. 1 and 2, it will be seen that the case and stand 10 of the present invention for a hand held stringed instrument, such as acoustical and electrical guitars, banjos, mandolins, violins, etc., includes a body portion 12 and a neck portion 14. The case and stand 10 has two sides 16 and 18, top and rear surfaces 20 and 22 and a flat bottom supporting surface 24. The side 16, 18, top 20, rear 22 and bottom 24 surfaces all have front edges defining a rectangular opening 26. A pair of doors 28 are hingedly affixed at 30 along the front edges of the side surfaces 16, 18. When the doors 28 are in the closed position they define continuations of the side surfaces 16, 18 and a front surface 32.

Figures 3, 4, 5:
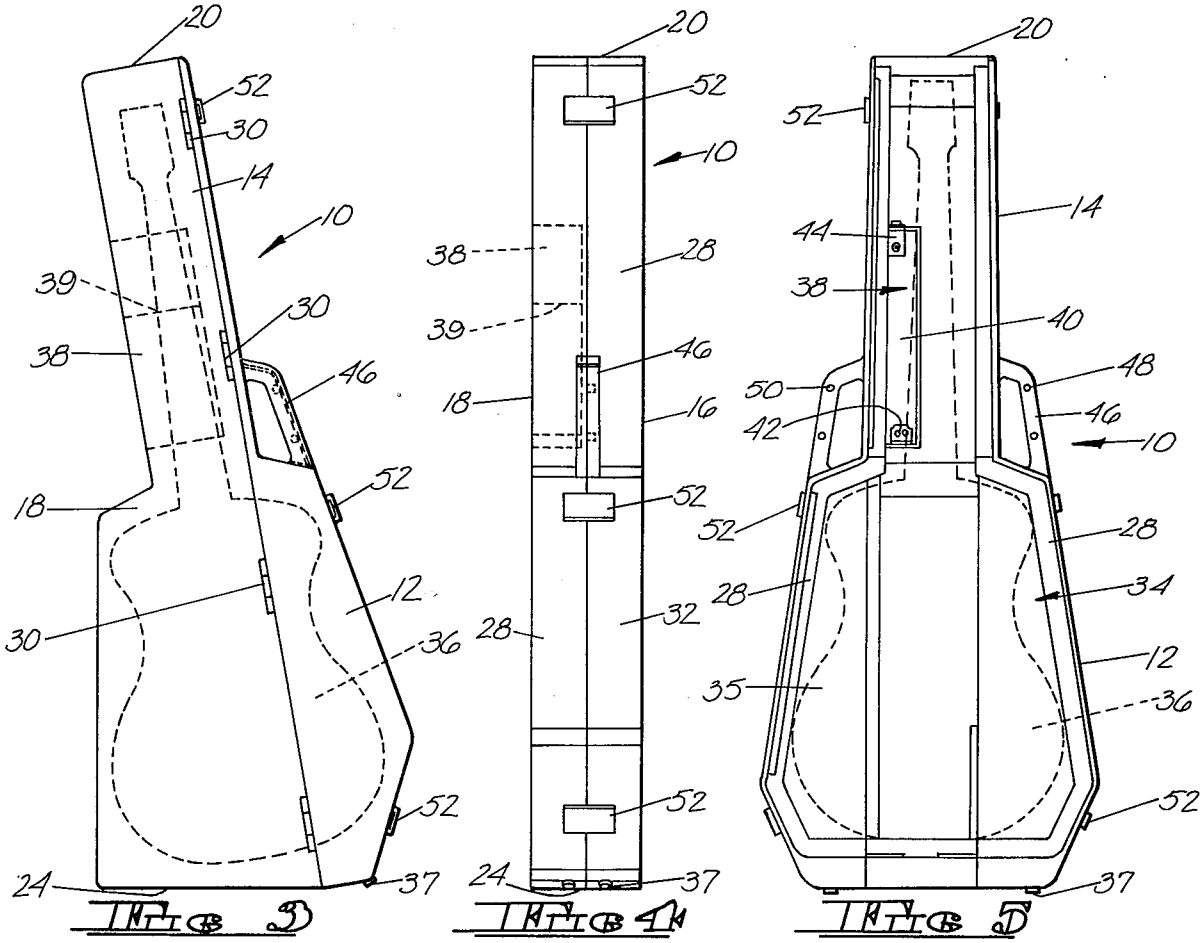
FIG. 3 is a side elevational view of the case and stand.
FIG. 4 is a front elevational view of the case and stand showing the doors in the closed position.
FIG. 5 is a front elevational view of the case and stand showing the doors in the open position.

As can be seen in FIGS. 2 and 5, the doors 28 in the open position define an instrument receiving pocket 34. Accordingly, an instrument, as shown in dashed lines at 36, may be positioned in the instrument receiving pocket 34 by orientation 90° to its normal carrying position within the case 10, as best seen in FIG. 3.

As can be seen, the flat bottom supporting surface 24 lies at an angle of about 80° with the long axis of the case and stand 10. Accordingly, the case and stand 10 may be easily positioned in the upright position. Furthermore, when the doors 28 are in the open position, as best seen in FIGS. 2 and 5, at which time a hand held stringed instrument may be supported in the instrument receiving pocket 34, the doors 28 form a 90° angle with the bottom supporting surface 24 so as to provide side-to-side stability for the case and stand 10. Further stability is provided by two stabilizer feet 37, which are provided on the lower portion of the front surface 32 of the doors 28.

A suitable handle portion 46 is attached to the front surface 32 formed by the doors 28. The handle portion 46 may be as shown in the drawings, or it may be extended downwardly along the front surface 32 of the doors 28 so as to be positioned more closely at the center of gravity of the case and stand 10 and thus distribute the weight more evenly when in transit.

The handle portion 46 may also be a split handle with a mating portion thereof on either door 28. One of the portions of the handle 46 is provided with apertures 48 which receive extensions 50 on the other portion when the doors 28 are in the closed position.

As can best be seen from FIGS. 3, 4 and 5, when the doors 28 are closed, the front and rear of an instrument 36 carried in the case and stand 10 face one of the side surfaces 16 and 18. A storage compartment 38 is secured to the neck portion 14 of the side surface 18 facing the rear of the instrument 36. The compartment 38 is provided with a front opening member 40, which is hinged at one end 42 and provided with a snapping closure 44 at the other end. The storage compartment 38 is sufficiently large to hold instrument picks and strings and also provides stabilization for the instrument 36 and easy accessibility. It may include a shelf 39 which is especially set to accommodate strings in the sizes sold commercially.

The case and stand 10 of the present invention is designed to receive a number of styles and sizes of hand held stringed instruments. This is possible because there is no curve in the case 10. Stringed instruments 36, such as guitars, have their curves at different heights and therefore a curve in the case 10 would limit the number of instruments that could be accommodated thereby. The case and stand 10 of the present invention are also preferably made of closed cell polyurethane foam, which has the ability to condense a great deal and then return to its original shape. Accordingly, depending upon the thickness of the foam, the case and stand 10 of the present invention will serve a number of sizes of hand held stringed instruments.

The interior of the case and stand 10 of the present invention is preferably covered with velour. Best results are obtained by placement of the foam and velour such that the foam placed at the bottom of the side surface 18 extends upwardly a limited distance, for example, six inches. This will hold the instrument 36 secure and there is no pressure on the strings, which results if the strings rub against the foam, causing pressure on the ends of the strings due to the horizontal pull to the vertical strings. Additionally, the instrument 36 is best received in the instrument receiving pocket 34 when only velour is used on the surface 35, i.e., continuations of the side surfaces 16 and 18, of the doors 28.

The case and stand of the present invention is designed to hold several styles and sizes of hand held stringed instrument, such as guitars. This is accomplished because of its straight sides, which extend from the upper to the lower bout area.

Best results have been found when the thickness of the case sides 16 and 18 is 5/32 inch and the front surface 32, 3/16 inch, since they are standard wood case measurements.

As previously indicated, the case 10, due to the shape of the flat bottom supporting surface 24, sits on an 80° angle with the long axis thereof. This provides enough of a slant so that the instrument 36 will not fall forward when the case 10 is used as a stand. Furthermore, the 90° at the base of the doors 28 provides side to side stability when the case 10 is open.

It has been found that the case 10 is preferably covered in black paroxlin vinyl. Black is preferred because of its resistance to dirt, ease in covering, and ability to stick to itself.

Three suitable hinges 52, such as Southco Series 200 draw catches, may be used for a strong, simple, long lasting corrosion resistant latch to maintain the pair of doors 28 in the closed position.

The handle 40 is preferably made from a foam with a steel insert.

The closed cell polyurethane foam used in the case and stand provides protection, resilience and recovery. It has been found preferable to utilize a $\frac{7}{8}$ inch foam on the sides 16, 18, because this is where the greatest variance occurs in guitar measurments. A ⅜ inch thick foam may be used elsewhere for protection and limited size variance.

The case and stand 10 of the present invention provides protection, transportation and display of the instrument 36. It enables easy access to the instrument 36 without laying the case 10 down or leaning it against something, and provides a stable, safe stand for easy removal and replacement of the instrument 36. The case 10 is adaptable to all types of case manufacturing materials, including soft shell, hard shell and plastic molded, and fits many types of sizes and shaped hand held stringed instruments 36 in one size and shape case 10.

Modifications may be made in the invention without departing from the scope and spirit thereof.

What is claimed is:

1. A combination case and stand for a hand held stringed instrument, said case and stand having a body portion and a neck portion and two side, top and rear surfaces, the lower end of said case and stand providing a flat bottom supporting surface lying at an angle of about 90° with the long axis of said case and stand, said side, top, rear and bottom surfaces all having front edges defining a substantially rectangular opening, said case and stand having a pair of doors hingedly affixed along the front edges of said side surfaces which open and close upon themselves to define an instrument display position and an instrument carrying position, respectively, said doors in said closed position defining continuations of said side surfaces and a front surface and in said open position defining an instrument receiving pocket and forming a 90° angle with said bottom supporting surface so as to provide side to side stability when said doors are in the open position, whereby when said doors are in the open position, said instrument may be positioned in said instrument receiving pocket by orientation 90° to its normal carrying position within said case and stand.

2. The case and stand according to claim 1, wherein said case and stand is formed of closed cell polyurethane foam.

3. The case and stand according to claim 1, wherein when said doors are closed, the front and rear of an instrument carried in said case and stand face one of said side surfaces, and wherein a storage compartment is secured to the neck portion of the side surface facing the rear of the instrument.

4. The case and stand according to claim 1, wherein a handle is attached to said front surface formed by said doors.

5. The case and stand according to claim 4, wherein said handle comprises a split handle with a mating portion thereof on each one of said doors.

6. The case and stand according to claim 5, wherein one of said mating handle portions is provided with at least one aperture which receives a mating extension positioned on the other one of said mating handle portions.

7. The case and stand according to claim 1, wherein two stabilizer feet are provided on the lower portion of said front surface of said doors.

8. The case and stand according to claim 1, wherein said case comprises closed cell polyurethane foam, the thickness of said foam of said side surfaces being greater than the thickness of said foam elsewhere in said case and stand.

* * * * *